US005649439A

United States Patent [19]

Schulz

[11] Patent Number: 5,649,439

[45] Date of Patent: Jul. 22, 1997

[54] TOOL FOR SEALING SUPERPLASTIC TUBE

[75] Inventor: David W. Schulz, Kent, Wash.

[73] Assignee: The Boeing Co., Seattle, Wash.

[21] Appl. No.: 469,304

[22] Filed: Jun. 6, 1995

Related U.S. Application Data

[62] Division of Ser. No. 228,488, Apr. 15, 1994, abandoned.

[51] Int. Cl.[6] ..... B21D 26/02

[52] U.S. Cl. ..... 72/62; 72/700; 72/709; 29/421.1

[58] Field of Search ..... 72/58, 59, 57, 72/60, 61, 62, 700, 709; 29/421.1

[56] References Cited

U.S. PATENT DOCUMENTS

| | | | |
|---|---|---|---|
| 2,038,304 | 4/1936 | Middler | 29/421.1 X |
| 2,292,462 | 8/1942 | Milford | 72/60 |
| 2,748,463 | 6/1956 | Mueller | 72/62 |
| 2,861,530 | 11/1958 | Mocha | 29/421.1 X |
| 3,340,101 | 9/1967 | Fields, Jr. | 72/61 |
| 3,896,648 | 7/1975 | Schertenleib | 72/61 |
| 3,900,939 | 8/1975 | Greacn | 29/401 |
| 4,392,602 | 7/1983 | Darby | 228/118 |
| 5,022,135 | 6/1991 | Miller et al. | 29/421.1 |
| 5,107,693 | 4/1992 | Olszewski et al. | 72/58 |
| 5,214,948 | 6/1993 | Sanders et al. | 72/62 |
| 5,233,855 | 8/1993 | Maki et al. | 72/62 |

FOREIGN PATENT DOCUMENTS 733669 7/1955 United Kingdom .

*Primary Examiner*—David Jones

*Attorney, Agent, or Firm*—Lawrence W. Nelson; J. Michael Neary

[57] ABSTRACT

A tool for sealing two ends of a tube of superplastic material in preparation for superplastically forming the tube against inside surfaces of a die by gas pressure inside of the tube. The tool has a longitudinal axis that is coincident with the longitudinal axis of the tube when the tool is positioned in the tube, and has two end caps with a cross-sectional shape similar to the cross-sectional shape of the tube ends on a plane perpendicular to the axis. A central connecting tube extends between and connects the two end caps. The end caps are made of a material having a coefficient of thermal expansion that is greater than the coefficient of thermal expansion of the tube, and expand, on heating, into intimate sealing contact with the inside surface of the tube ends. A gas connector in at least one of the end caps, located in the end cap radially outside the connection of the connecting tube to the end cap, connects a gas line from a gas management system for introducing forming gas under pressure into the tube, after the ends thereof are sealed by the end caps and the tube is heated to the thermoplastic forming temperature thereof, for inflating the tube against the inside surfaces of the die. The gas needs to fill and act only in the volume between the connecting tube and the tube instead of the entire volume of the tube, thereby saving forming gas.

7 Claims, 3 Drawing Sheets

24
20
30
26
22
34
28
32
48
44
42
40
49
46
36
47
38
52
50
54

Fig. 6
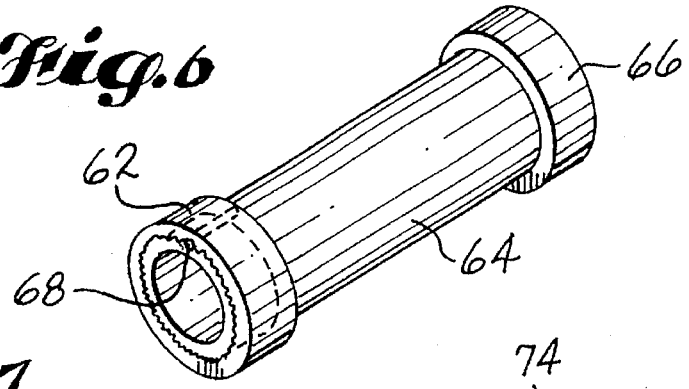
Fig. 7
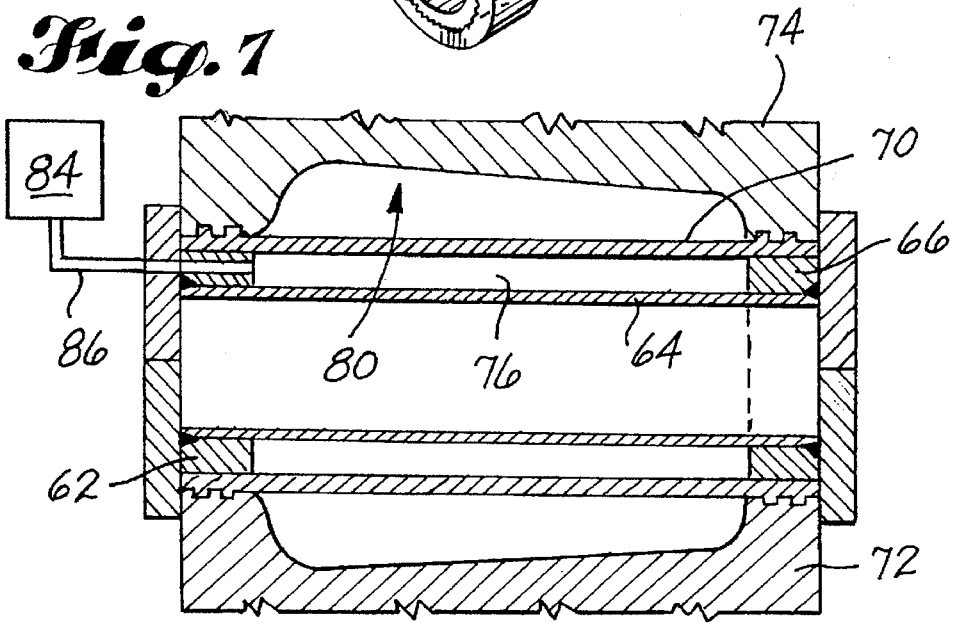
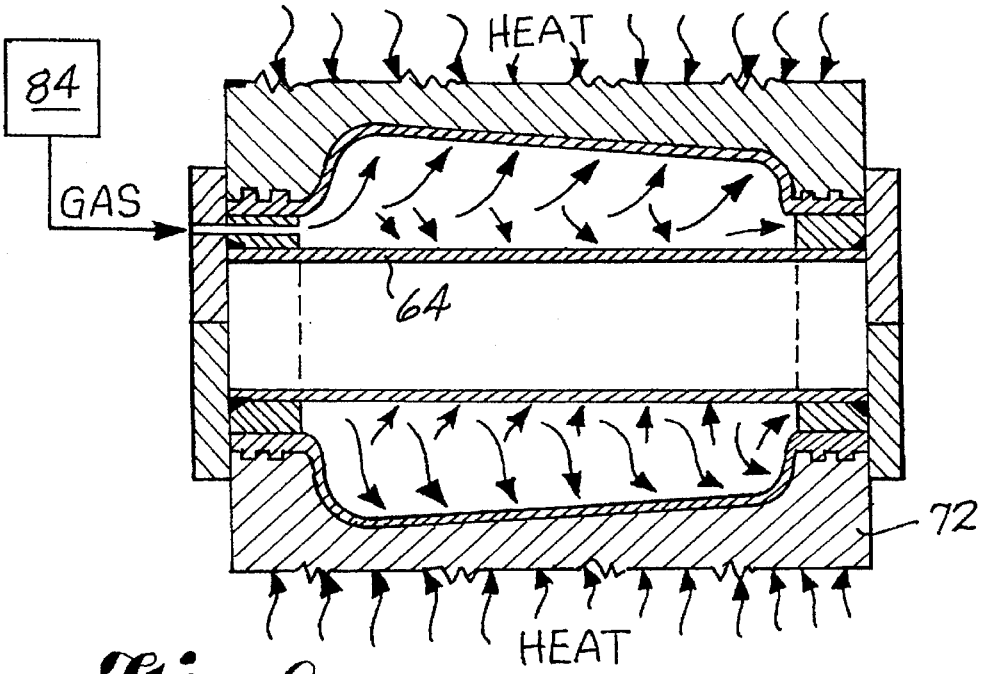
Fig. 8

74
64
66
68
62
78
80
76

TOOL FOR SEALING SUPERPLASTIC TUBE

This is a division of U.S. patent application Ser. No. 08/228,488 filed on Apr. 15, 1994, now abandoned, and entitled "End Sealing for Superplastic Tube Forming".

This invention relates to superplastic forming of tubular structures, and more particularly to end sealing of a tubular blank of superplastic material in preparation for superplastic forming to the final shape.

BACKGROUND OF THE INVENTION

Superplastic forming is a process which utilizes the properties of certain materials that can be extensively strained at relatively low stress levels when heated to an elevated temperature known as the superplastic forming temperature. Certain formulations of aluminum, rolled in a certain pattern, exhibit superplacticity at superplastic temperatures, as do titanium and some titanium alloys, certain stainless steels and some super alloy materials. All of these materials have been used to form low tolerance parts with little or no residual stress, which would have been difficult or impossible to achieve with prior art metal forming processes.

The forming of tubular structures by superplastic forming in the past has been performed by superplastic forming two longnitudial halves of the part as separate pieces and welding the two pieces together to make the final part. This process can produce a satisfactory part, but it is costly and great care must be taken to avoid quality problems, especially if the part must be capable of withstanding gas pressure.

An ideal method of forming tubular parts by superplastic forming would be to begin with a tubular blank and to superplastically form the tubular blank against inside cavity surfaces in a die having an internal configuration like the external shape of the final part. This process would eliminate the cost of making the parts in two halves then welding the halves together and would result in a seamless part having excellent part quality and minimal variation from part to part.

A conventional superplastic forming process utilizes a sheet of superplastic material which is captured around its peripheral edge between a die base and a die lid. The sheet is heated to superplastic forming temperature in the die and the sheet is then strained into contact with the surface of the die cavity by gas pressure introduced under the die lid. The tubular analog to the flat sheet superplastic forming process, that is, using the forming gas pressure to form a tube of superplastic material against internal surfaces in a die cavity, would require that the tube be sealed around the peripheral edges of both ends of the tube to establish a pressure zone inside the tube for straining the tube material outward into contact with the inside surfaces of the die cavity. The sealing of the tube in a superplastic forming die can be complicated and unreliable because of the various factors involved in superplastic forming, including the very high temperatures at which certain materials become superplastic and the high pressure of the forming gas required to strain the material, even at a superplastic temperature. Thus, there has long been an unfulfilled need in the art to provide a simple, inexpensive and reliable method and an apparatus for sealing the ends of a superplastic tube in a superplastic forming die for superplastic forming of the tube.

SUMMARY OF THE INVENTION

Accordingly, it is an object of this invention to provide an improved method for superplastic forming of tubular structures. Another object of the invention is to provide an improved method for end sealing of tubular blanks of superplastic material in a die for superplastic forming of tubular structures. Yet another object of the invention is to provide a tool for sealing the ends of a tubular blank of a superplastic material in preparation for superplastic forming of the blank to form a tubular part. Still another object of the invention is to provide a tool for sealing the ends of a tubular blank in a superplastic forming die, which tool can be removed after forming and reused many times to make additional parts. A still further object of the invention is to provide a superplastically formed part, made from a tubular blank having ends which were sealed to contain the forming gas pressure introduced to form the tubular blank against the inside surface of a superplastic forming die.

These and other objects of the invention are attained in two embodiments of a method of sealing the ends of a tubular blank of superplastic material against escape of forming gas introduced into the interior of the tube. One method includes welding an end cap on each end of the tubular blank, and providing a gas inlet tube in at least one of the end caps. After superplastic forming the tubular blank to produce the tubular part, the two end portions of the tube, including the end caps, are severed from the tubular part to produce two open ends of the part. A second embodiment of the method utilizes a reusable tool having end caps which fit snugly in the tubular blank. The end caps have a coefficient of thermal expansion greater than the coefficient of thermal expansion of the tubular blank, so when the blank and the installed tool are heated in the die, the end caps expand more than the tubular blank to produce a sealing interference fit between the end caps and the blank. A connection is provided in at least one end cap to enable the interior of the tubular blank to be pressurized with forming gas for forming the tubular blank against the inside surfaces of the die for superplastically forming the tubular part.

DESCRIPTION OF THE DRAWINGS

The invention and its many attendant objects and advantages will become better understood upon reading the following description of the preferred embodiments in conjunction with the following drawings, wherein:

FIG. 6 is a perspective view of a tool for use in a second embodiment of the process for superplastic forming of tubular structures;

FIG. 7 is a cross sectional elevation of the tool shown in FIG. 6, mounted into a tubular blank and installed in a superplastic forming die;

FIG. 8 is a cross-sectional elevation of the assembly shown in FIG. 7 after superplastic forming of the tubular blank.

DESCRIPTION OF THE PREFERRED EMBODIMENTS

Figures 1, 2, 3, 4, 5:
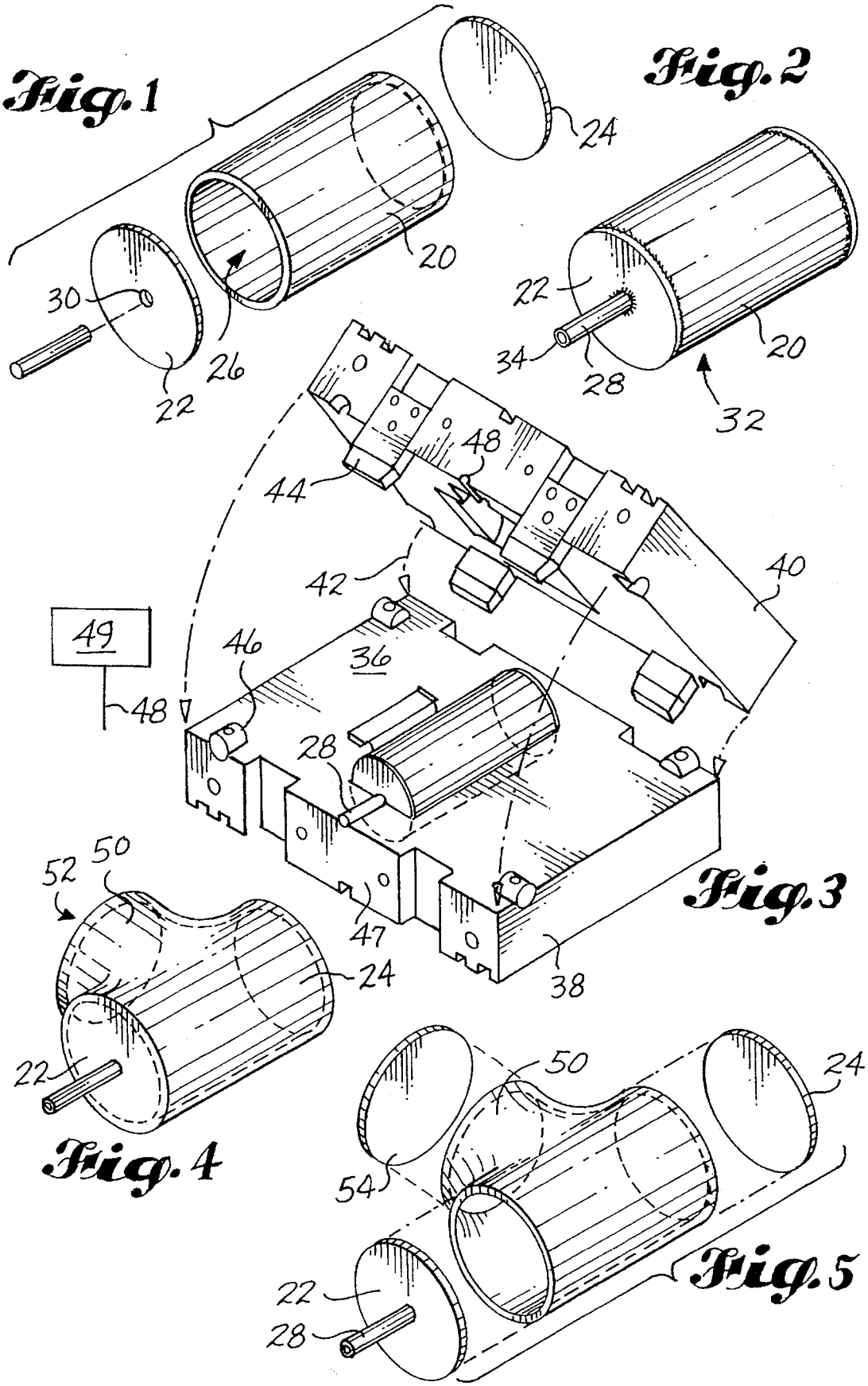
FIG. 1 is a perspective view of a tubular blank and two end caps to be assembled and welded in preparation for superplastically forming a part.
FIG. 2 is a perspective view of the elements shown in FIG. 1, after welding into an integral assembly.
FIG. 3 is a perspective view of a superplastic forming die in which the assembly shown in FIG. 2 has been inserted for forming into a part.
FIG. 4 is a perspective view of the formed structure removed from the die shown in FIG. 3 after superplastic forming of the blank.
FIG. 5 is an exploded perspective view of the structure shown in FIG. 4, wherein the two end caps have been severed from the ends of the structure shown in FIG. 4 and the end of the pullout formed during superplastic forming has been severed to produce the final part.
Figure 9:
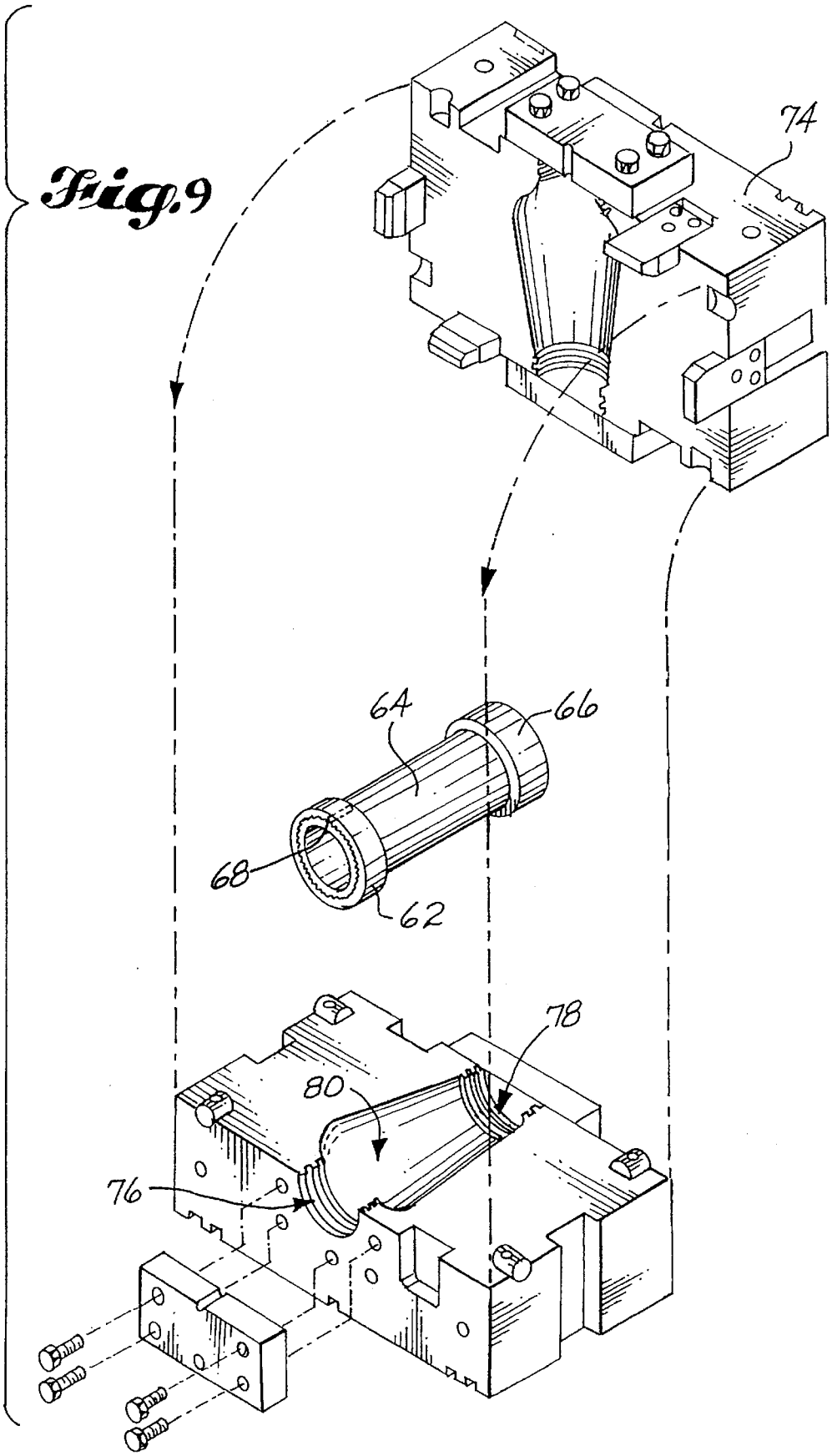
FIG. 9 is a perspective view of the assembly shown in FIG. 7 opened and exploded to show the elements separately.

Turning now to the drawings, wherein like reference characters designate identical or corresponding characters, and more particularly to FIG. 1 thereof, a tubular blank 20 is shown which will be welded into the integral tubular assembly shown in FIG. 2 and formed in the die shown in FIG. 3 to produce a formed tubular structure shown in FIG. 4 which is then trimmed to produce the tubular part having a pull-out shown in FIG. 5. The tubular blank 20 is a seamless or welded tube of titanium alloy containing titanium, aluminum and vanadium, but instead it could be other commercially useful alloys of titanium such as titanium 15-3-3-3. Two end caps 22 and 24 are welded onto the ends of the tube 20 to produce a sealed interior volume 26 within the tube 20 and between the two ends 22 and 24. The end caps 22 and 24 will usually be the same material as the tube 20, but need not be since they do not need to be superplastic for the process to work as described herein. A gas pipe connection 28 is inserted in a hole 30 drilled through the center of the end cap 22 and is welded into place to form a gas tight connection between the gas pipe connection 28 and the end cap 22. The welded assembly 32, shown in FIG. 2, is completely gas tight except for the opening into the enclosed volume 26 through the end 34 of the gas pipe 28.

If desired for gas purging of air, a pipe similar to the gas pipe 28 may be provided in the cap 24 for connection to a purge line. This would provide a cross channel flow path for a purging air out of the enclosed volume 26 to minimize formations of oxide or alpha case on the inside walls of the tube 20 during superplastic forming of the welded assembly 32. However, the preferred embodiment does not utilize a purge line because, after forming, the part is treated in an acid etch solution to remove the alpha case that forms on the outside surface of the part, so purging the inside would merely waste time and forming gas since the inside surface is etched at the same time as the outside surface anyway.

As shown in FIG. 3, the welded assembly 32 is inserted in a cavity 36 in a die base 38 and die lid 40 having a corresponding cavity 42 is placed over the die base 38 using alignment posts 44 and alignment plugs 46 to position the lid 40 accurately on the base 38. As understood by those skilled in the art, the die base 38 and the die lid 40 are normally held in a press having heated platen so that the die lid 40 is lowered onto the die base 38 when the die is to be closed by lowering the upper platen of the press (not shown). The usual practice is for the die 38–40 to be heated to a temperature at or about the superplastic forming temperature of the blank 20 before the welded assembly 32 is inserted in the cavity 36–42. After closing the die lid 40 on the base 38, the welded assembly 32 quickly reaches superplastic forming temperature and is ready to be expanded by forming gas pressure to assume the shape of the die cavity 36–42.

The connection tube 28 projects out beyond the outer edge of the die 38–40 through a hole drilled through the die wall 47 at the parting line of the die. A gas line 48 is connected to the gas connection tube 28 and leads to a gas management system 49 such as that disclosed in U.S. patent application Ser. No. 08/138,282 filed on Oct. 15, 1993 entitled "Gas Control for Superplastic Forming", the disclosure which is incorporated herein by reference. This gas management system controls the flow of forming gas, normally argon, under pressure into the interior of the welded assembly 32 through the gas line 48 and the connection pipe 28 to apply gas pressure against the interior walls of the tubular blank 20. The pressure of the forming gas against the inside walls of the tubular blank 20 at superplastic forming temperature strains the walls outward against the inside surfaces of the cavity 36–42 and so that the blank 20 assumes the shape of a cavity 36–42 in the die. In the case of the part illustrated in FIG. 5, the tube is provided with a central pull-out 50 to serve as a T connection for a cylindrical duct.

After forming, the gas pressure in the formed structure 52 shown in FIG. 4 is reduced to atmospheric pressure and the die lid 40 is raised off of the die base 38. The formed structured 52 cools quickly when exposed to the air and can be removed from the cavity 36 with handling equipment or protective gloves. When the structure 52 is cooled to room temperature, the end caps 22 and 24 are severed as indicated in FIG. 5, and a disc 54 is cut off the end of the pull-out 50 to produce a cylindrical duct with a cylindrical pull-out 50 to function as a T connection in a cylindrical duct network.

A second embodiment of the invention utilizes a reusable tool in the form of a spool shown in FIG. 6. The spool 60 includes an end cap 62 welded to one end of a connecting tube 64 and second end cap 66 welded to the other end of the connecting tube 64. The end cap 62 has an axial hole 68 extending completely through the end cap and communicating from the left hand edge surface through to the right hand edge surface of the end cap 62. The outside diameters of the end caps 62 and 66 are equal and are just slightly less than the internal diameter of a tubular blank 70 of superplastic material such as the titanium alloy used in the tubular blank 20 shown in FIG. 1. The spool 60 slides with a snug fit into the tubular blank 70 and the assembly is placed in a heated split die having a die base 72 and a die lid 74. The die is closed in the same manner as the die in FIG. 3, and the heat in the die raises the temperature of the assembled spool 60 and tubular blank 70 to the superplastic forming temperature of the blank 70.

Before forming gas can be introduced into the cylindrical annular space 76 between the connecting tube 64 and the tubular blank 70, the ends of the tubular blank 70 must be sealed against escape of the pressurized forming gas. The sealing of the tubular blank 70 is accomplished by differential expansion of the end caps 62 and 66 relative to the expansion of the tubular blank 70. The die base 72 and die lid 74 are both made of a high temperature tool steel such as ESCO 49C. Likewise, the end caps 62 and 64 and the connecting tube 64 are also made of ESCO 49C tool steel. The diameter of the circular openings 76 and 78 of the cavity 80 in the die 72–74 at the superplastic forming temperature of the tubular blank 70 is larger than the external diameter of the tubular blank 70 at room temperature but smaller than the external diameter of the tubular blank 70 at superplastic forming temperature, so the assembly of the tubular blank 70 and the spool 60 may be placed in the cavity 80 of the die 72–74, with the ends of the blank 70 containing the end caps 62 and 66 in the circular openings 76 and 78, and the die lid 74 closed on the die base 72. However, the external diameter of the end caps 62 and 66 at room temperature is such that, on expansion of the end caps 62 and 66 as the spool 60 equalizes in temperature with the die 72–74 after closing, the annular space between the end caps 62 and 66 reduces to less than the thickness of the tubular blank 70. As a consequence, an interference fit is created in the annular space between the end caps 62 and 66 and their respective circular openings 76 and 78.

Because the assembled tubular blank 70 and the spool 60 is cool when it is installed in the die 72–74, it fits into the circular openings 76 and 78 without interference and the die lid 74 can be closed and clamped securely on the die base 72 by the press in which the die halves are installed. Because of the configuration of the assembled tubular blank 70 and the spool 60 inside the tubular blank 70, the tubular blank 70 heats first and expands, followed by the heating of the spool 60. The coefficient of thermal expansion of the ESCO 49C, about $11.1\times10^{-6}$ in/in/°F. at 1650° F., is greater than the coefficient of thermal expansion of the titanium alloy used in the blank 70, which is about $6.2\times10^{-6}$ in/in/°F. at 1650° F. Therefore the end caps 62 and 66 expand greater than the tubular blank 70. The dimensions of the circular openings 76 and 78 in the die cavity 780 and the external diameter of the end caps 62 and 66 is selected so that the annular space between the end caps 62 and 66 and the corresponding circular openings 76 and 78 is smaller than the thickness of the tubular blank 70. When the end caps 62 and 66 finally reach their full operating temperature which is the temperature of the superplastic forming temperature of the blank 70, the blank 70 has already reached superplastic forming temperature and the overlapping dimensions causes the superplastic material of the tubular blank 70 to be forced into a sealing surface profile cut into the die around the circular openings 76 and 78. The flowing of the superplastic material into the seal profiles facilitates the sealing of the interface between the blank 70 and the circular openings 76 and 78, and between the blank 70 and the end caps 62 and 66, and also prevents development of excessive stresses in the die 72–74 which could possible occur otherwise.

Forming gas introduced under pressure from a gas management system 80 like the gas management system 49 used in the embodiment of FIG. 3, strains the tubular blank 70 as illustrated in FIG. 8 into contact with the interior surfaces of die 72–74.

After the tubular blank 70 has been formed against the inside surfaces of the inside cavity 80, the gas management system 84 reduces the forming gas pressure to atmospheric and the die lid 74 is opened by raising the upper platen of the press. The formed blank 70 cools quickly when exposed to air at room temperature and the formed blank and the spool 60 can be lifted out of the cavity 80. The contraction of the end caps 62 and 66 is greater than the contraction of the end portions of the blank 70 because of dirrerential coefficients of thermal expansion, enabling the spool 60 to slide axially out of the formed blank 70. The formed blank 70 is trimmed and cleaned to produce the final part.

Obviously, numerous modifications and variations of the preferred embodiments disclosed here and will become apparent to those skilled in the art upon reading this disclosure and examining the drawings. Accordingly, it is expressly to be understood that these modifications and variations, and the equivents thereof, may be practiced while remaining in the spirit and scope of the invention as defined in the following claims.

Therein I claim:

1. A tool for sealing two ends of a tube of superplastic material in preparation for superplastically forming said tube against inside surfaces of a die by gas pressure inside of said tube, said tool having a longitudinal axis that is coincident with the longitudinal axis of said tube when said tool is positioned in said tube, said tool comprising:

two end caps having a cross-sectional shape similar to the cross-sectional shape of said tube ends on a plane perpendicular to said axis;

said end caps having a coefficient of thermal expansion that is greater than the coefficient of thermal expansion of said tube;

whereby said end caps expand, on heating, into intimate sealing contact with an inside surface of said tube ends.

2. A tool as defined in claim 1, further comprising:

a gas connector in at least one of said end caps for connecting a gas line from a gas management system for introducing forming gas under pressure into said tube, after the ends thereof are sealed by said end caps and said tube is heated to the thermoplastic forming temperature thereof, for inflating said tube against said inside surfaces of said die.

3. A tool as defined in claim 1, further comprising:

a central connecting tube having two ends, said central connecting tube extending between and connected to said two end caps at said ends of said connecting tube.

4. A tool as defined in claim 3, wherein:

said end caps are sealed to the ends of said connecting tube, and said gas connector is located in said end cap radially outside the connection of said connecting tube to said end cap;

whereby said gas needs to fill and act only in the volume between said connecting tube and said tube instead of the entire volume of said tube, thereby saving forming gas.

5. A tool as defined in claim 3, wherein:

said connecting tube is welded to said end caps.

6. A tool as defined in claim 3, wherein:

said end caps are annular in shape, each having a central opening for receiving said central tube.

7. A tool as defined in claim 3, wherein:

said tube material is titanium alloy having a coefficient of thermal expansion in the range of $5–8\times10^{-6}$ in/in/°F., and said end caps are a steel alloy having a coefficient of thermal expansion in the range of $9–12\times10^{-6}$ in/in/°F.

* * * * *